US012516815B2

(12) United States Patent
Wasserman et al.

(10) Patent No.: US 12,516,815 B2
(45) Date of Patent: Jan. 6, 2026

(54) COMBUSTOR LINER PANELS

(71) Applicant: RTX CORPORATION, Farmington, CT (US)

(72) Inventors: David Wasserman, Farmington, CT (US); Howard Liles, Farmington, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/047,035

(22) Filed: Feb. 6, 2025

(65) Prior Publication Data

US 2025/0314381 A1 Oct. 9, 2025

Related U.S. Application Data

(63) Continuation of application No. 18/627,769, filed on Apr. 5, 2024, now Pat. No. 12,313,261.

(51) Int. Cl.
*F23R 3/00* (2006.01)
*F23R 3/60* (2006.01)

(52) U.S. Cl.
CPC ..... *F23R 3/002* (2013.01); *F23R 3/007* (2013.01); *F23R 3/60* (2013.01)

(58) Field of Classification Search
CPC ..... F23R 3/002; F23R 3/007; F23R 3/60
See application file for complete search history.

(56) References Cited

U.S. PATENT DOCUMENTS

| | | | |
|---|---|---|---|
| 4,302,941 | A | 12/1981 | DuBell |
| 5,697,213 | A | 12/1997 | Brewer |
| 5,957,067 | A | 9/1999 | Dobbeling et al. |
| 10,969,103 | B2 | 4/2021 | Chang et al. |
| 11,215,367 | B2 | 1/2022 | Kramer |
| 11,543,132 | B2 | 1/2023 | Kobayashi et al. |
| 2014/0130501 | A1 | 5/2014 | Clemen |
| 2016/0025345 | A1 | 1/2016 | Chandler et al. |
| 2018/0179958 | A1 | 6/2018 | Macelloni |
| 2018/0335211 | A1 | 11/2018 | Quach |
| 2019/0264923 | A1 | 8/2019 | Kobayashi et al. |
| 2019/0277500 | A1 | 9/2019 | Haeny |

FOREIGN PATENT DOCUMENTS

| | | |
|---|---|---|
| EP | 1635118 B1 | 9/2008 |
| EP | 2596290 B1 | 8/2015 |

OTHER PUBLICATIONS

European Search Report dated Jul. 28, 2025 issued in corresponding application 25168680.4.

*Primary Examiner* — Steven M Sutherland
(74) *Attorney, Agent, or Firm* — Millen, White, Zelano & Branigan P.C.; Ryan R. Pool

(57) ABSTRACT

A combustor liner segment which includes base having an inner surface, an outer surface, a front edge, a rear edge, and two side edges. The liner segment further includes a front wall extending from the front edge of the base, and a rear wall extending from the rear edge of the base. The combustor liner segment also includes at least one support member having a first portion and second portion. The combination of the first portion, the second portion, the outer surface, the front wall, and the rear wall form a partially enclosed space.

18 Claims, 6 Drawing Sheets

COMBUSTOR LINER PANELS

FIELD OF THE INVENTION

The present application relates to combustor liner panels as used, for example, in gas turbine engines. In particular, the present application relates to combustor liner panels made from superalloys or ceramic matrix composite (CMC) materials, and arrangements for attaching such combustor liner panels to a combustor housing.

BACKGROUND

Combustor liner panels used, e.g., for gas turbine combustors, have an inner surface (hot side) that faces the interior of the combustor, and an outer surface (cold side) that faces the combustor housing. Combustor liner panels currently in service are typically mounted to the combustor housing via studs that are integrally cast into the liner panel. The bases of the studs are positioned at the hot flow path surface (i.e., at the inner surface of the liner panel) and thus are subjected to hot gas environments. For this reason, steps are taken to cool the studs to prevent damage thereto.

The prior art practice is to point an array of effusion cooling apertures around the stud but having no such apertures in the region where the stud is positioned. Further the presence of the stud can result in the clock angle of at least some of these effusion apertures to oppose the mainstream combustion flow direction. When the clock angle of these effusion apertures aligns with the mainstream combustion flow direction, they function to create a cooling layer on the surface of the liner panel that protects it from the hot combustion gases. However, when the clock angle of these effusion apertures are misaligned to the mainstream combustion flow direction, the cooling layer can be disrupted leading to burning around the stud and damage to the fasteners positioned in this area. Over time, this burning can result in partial or complete burn-thru of the area of the panel around the stud and in some cases can result in ultimate liberation of the stud and resultant damage to the engine.

There exists a need for combustor liner panels, and arrangements for attaching combustor liner panels to combustor housings, which ameliorate the issues discussed above.

SUMMARY OF THE INVENTION

In one embodiment of the present disclosure, a combustor liner segment is provided in which the liner segment includes a base having an inner surface (hot side), an outer surface (cold side), a front edge, a rear edge, and two side edges, a front wall arranged perpendicular to the base and extending from the front edge, and a rear wall arranged perpendicular to the base and extending from the rear edge.

In this embodiment, the combustor liner segment also includes at least one support member wherein each support member comprises a first portion and a second portion. The first portion has a first end and a second end, wherein the first end is connected to the outer surface of base. The second portion extends laterally from the second end of the first portion and is spaced from the outer surface of the base. The second portion comprises at least one mounting orifice. Additionally, the first portion, the second portion, the outer surface, the front wall, and the rear wall form a partially enclosed space.

In another embodiment of the present disclosure, a combustor is provided where the combustor includes a combustor housing having an inner surface and an outer surface. The combustor also includes at least three combustor liner segments, where each liner segment includes a base having an inner surface (hot side), an outer surface (cold side), a front edge, a rear edge, and two side edges, a front wall arrange perpendicular to the base and extending from the front edge, and a rear wall arrange perpendicular to the base and extending from the rear edge.

In this embodiment, each combustor liner segment also includes at least one support member wherein each support member comprises a first portion and a second portion. The first portion has a first end and a second end, wherein the first end is proximal to the base and is connected to the outer surface of base and the second end is distal with respect to the base. The second portion extends laterally from the second end of the first portion and comprises at least one mounting orifice. Additionally, the first portion, the second portion, the outer surface, front wall, and rear wall form a partially enclosed space.

According to a further embodiment of the present disclosure, a method of assembling a combustor is provided. The method includes providing a combustor housing having an inner surface and an outer surface and attaching at least three combustor liner segments to the outer surface of the combustor housing by fasteners that pass through mounting orifices in each of the combustor liner segments, where each combustor liner segment includes a base having an inner surface (hot side), an outer surface (cold side), a front edge, a rear edge, and two side edges, a front wall arrange perpendicular to the base and extending from the front edge, and a rear wall arrange perpendicular to the base and extending from the rear edge.

In this embodiment, each combustor liner segment also includes at least one support member wherein each support member comprises a first portion and a second portion. The first portion has a first end and a second end and the first end is connected to the outer surface of the base. The second portion extends laterally from the second end of the first portion and is spaced from the curved segment. The second portion comprises at least one mounting orifice. Additionally, the first portion, the second portion, the outer surface, the front wall, and the rear wall form a partially enclosed space.

BRIEF DESCRIPTION OF THE DRAWINGS

Implementations of the inventive concepts disclosed herein may be better understood when consideration is given to the following detailed description thereof. Such descriptions make reference to the included drawings, which are not necessarily to scale, and which some features may be exaggerated and some features may be omitted or may be represented schematically in the interest of clarity. Like reference numerals in the drawings may represent and refer to the same or similar element, feature, or function. In the drawings.

DETAILED DESCRIPTION

Combustor panels provide protection for the combustor housing. Combustor panels are formed by attaching a plurality of liner segments (e.g., three liner segments) to the inner surface of the combustor housing. Each liner segment is mounted onto the inner surface of the combustor housing using fasteners. In embodiments described in more detail below, the liner segment structures are designed to isolate the fasteners from the flow of hot gases at the inner surface of the liner segments.

Figure 1:
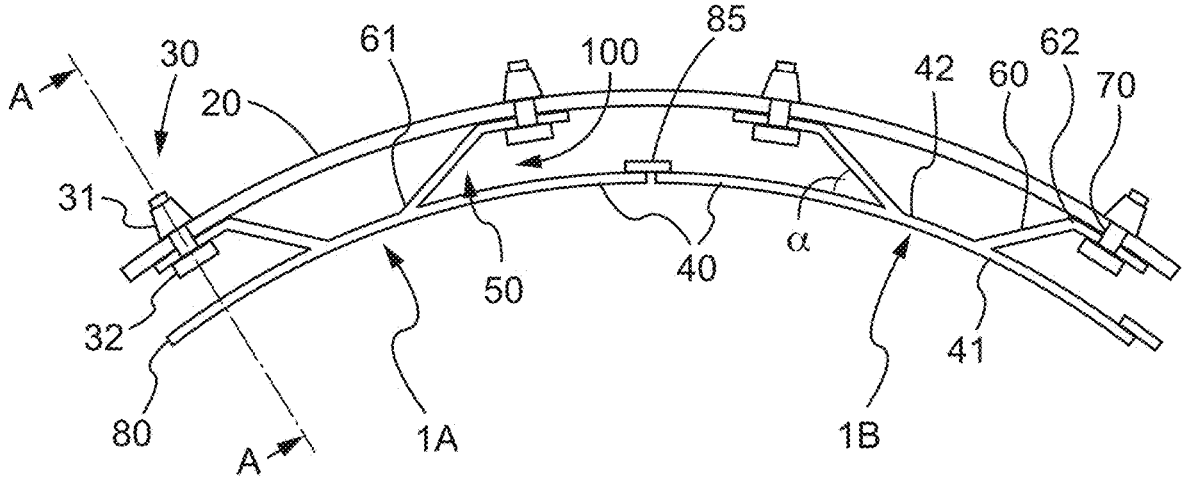
FIG. 1 illustrates a sectional view through the combustor, looking down the engine centerline, which shows two combustor liner panels attached to a combustor housing.

FIG. 1 shows a sectional view through the combustor looking down through the engine centerline. As shown in FIG. 1, two liner segments (1A) and (1B), made, for example, of CMC material (e.g., a SiC/SiC CMC) or superalloys (e.g., an investment cast superalloy), are joined to the combustor housing (20) by fasteners (30). As shown in FIG. 1, the fasteners (30) can be, for example, nut (31) and bolt (32) fasteners. Other fastener types are also acceptable to join a liner segment (1A or 1B) to the combustor housing (20).

Each liner segment (1A and 1B) includes a base (40) having an inner surface (41) and outer surface (42). The inner surface (41) faces the interior of the combustor and thus comes into contact with the flow of hot gases passing through the combustor. The outer surface (42) faces the combustor housing (20). In the embodiment shown in FIG. 1, to match the curvature of the combustor housing (20), the inner surface (41) of base (40) of the liner segment has a concave shape and the outer surface (42) is convex.

The liner segment also includes at least one support member (50). In the embodiment of FIG. 1, each liner segment (1A and 1B) has two support members (50). Each support member has a first portion (60) and a second portion (70). The first portion (60) has a first end (61), proximal to the outer surface (42) of the base (40), which is connected to a central region of the outer surface (42). The second end (62) of the first portion (60) is distal with respect to the outer surface (42). In the embodiment of FIG. 1, the first portion (60) of each support member (50) makes an angle $\alpha$ with the base (40) which is less than 90°. Angle $\alpha$ can be, for example, 30 to 80 degrees, or 35 to 60 degrees, or 40 to 50 degrees. The second portion (70) of support member (50), which can be continuous with the first portion (60), extends laterally from the second end (62) of the first portion (60) towards a side edge (80) of the base (40). Each second portion (70) has one or more mounting orifices for receiving fasteners. These orifices are shown in more detail in FIG. 3.

In FIG. 1, liner segment (1A) is joined to adjacent liner segment (1B) in a shiplap configuration via joint member (85). Joint member (85) also functions to block inter-segment gaps and while allowing for expansion and contraction of the liner segments (1A) and (1B). Joint member (85) may be integral to one or both liner segments which it connects. The blocking of the inter-segment gaps prevents a direct passageway for hot gases from the hot flow path for the combustor to pass beyond the inner surface (41) of base (40) of the liner segments (1A) and (1B).

Fasteners (30) extend through the combustor housing (20) and connect to the second portions (70) of the support members (50). The fasteners do not extend through the base (40) and, as a result, are not subjected to the hot gas flow within the combustor. The portions of the fasteners (30) that extend through the combustor housing (20) are positioned within a space (100) that is partially enclosed by the base (40), the support member (50), and front and rear walls of the liner segment (1). The arrangement forming this partially enclosed space (100) is shown in more detail in FIG. 2.

Figure 2:
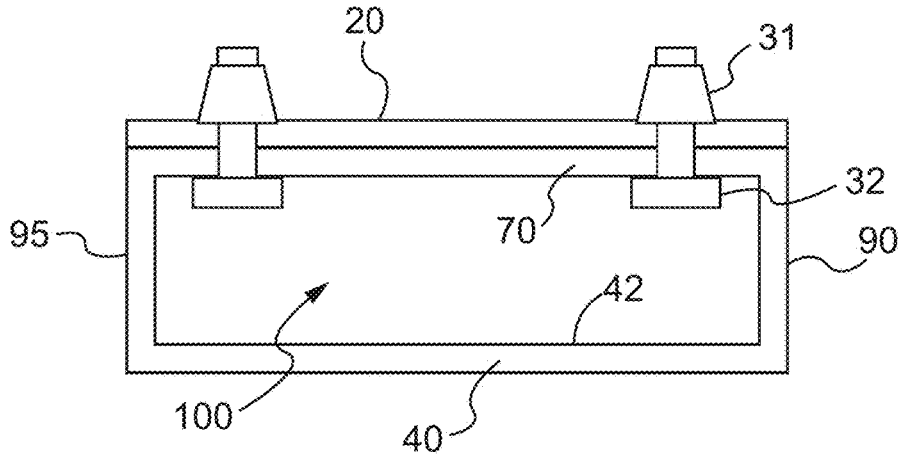
FIG. 2 illustrates a cross sectional view of a combustor liner panel of FIG. 1 along line A-A.

FIG. 2 shows a cross section view of the embodiment of FIG. 1 along line A-A. In the view of FIG. 2, the front wall (90) and rear wall (95) of the combustor liner segment (1A) are visible. Together with the first (60) and second portions (70) of the support member (50) and the base (40), the front wall (90) and rear wall (95) partially enclose space (100) which houses fasteners (30) and protects them from the hot flow path of the combustor. As shown in FIG. 2, the combustor liner segments (1) are attached to combustor housing (20) via fasteners (30) that extend through mounting orifices (71) in the second portion (70) of support member (50) and into the partially enclosed space (100).

When, as shown in FIG. 1, combustor liner segments (1A) and (1B) are positioned next to each other, and attached to combustor housing (20), a partially enclosed space formed by liner segment (1A) and a partially enclosed space formed by liner segment (1B) together form parts of a larger enclosure. In embodiments where, the front wall (90) and the rear wall (95) extend all the way to side edges (80) of the liner segment (1), and a vertical shiplap end (85) covered the intersegment gap, a completely enclosed space is formed. The combustor housing (20) forms part of this larger enclosure by bridging the gap between the second portion (70) of a support member (50) of liner segment (1A) and the second portion (70) of a support member (50) of liner segment (1B). The fasteners (30) are positioned within this larger enclosure are shielded from the flow of hot gases through the combustor.

Figure 3:
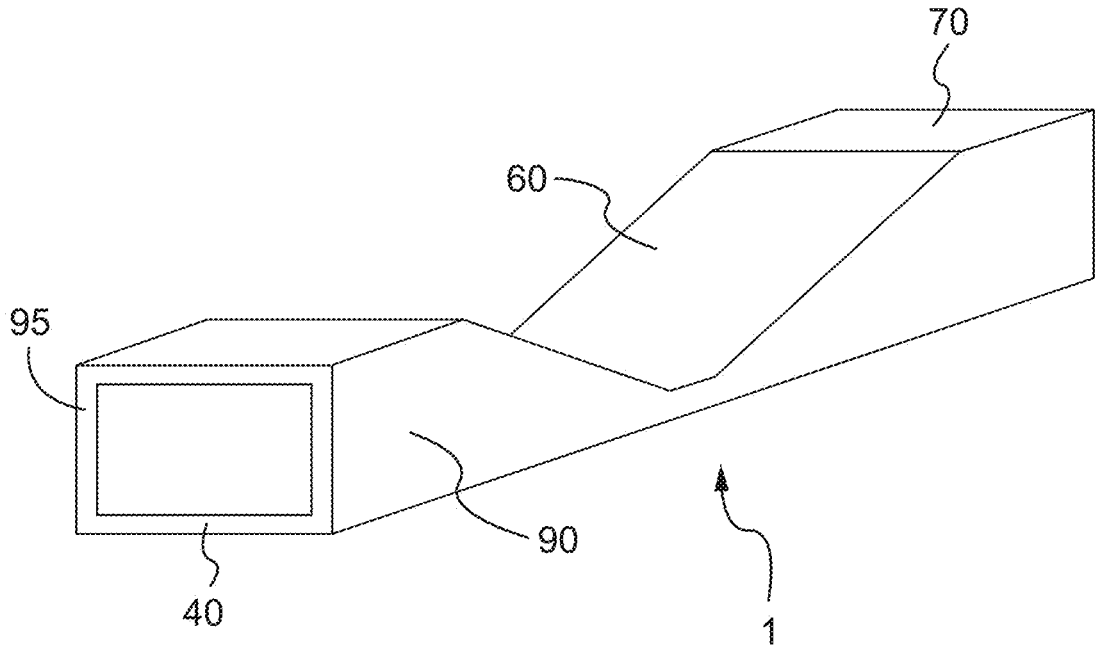
FIG. 3 is an isometric view of the combustor liner segment of FIG. 1 showing the second portion of each support member extending in a direction away from the center region of the combustor liner segment.

FIG. 3 is an isometric view of the liner segment embodiment of FIG. 1. Front wall (90) and rear wall (95) connect the base (40) to the first portion (60) and second portion (70) of each support member (50). Together with the base (40) and the first (60) and second (70) portions of each support member (50), the front wall (90) and the rear wall (95) form a partially enclosed space where fasteners (30) may be positioned and protected from the hot flow path of the combustor.

As can be seen from FIG. 3, this liner segment embodiment forms a wavelike pattern where the crest of the wave is formed by the second portion (70) of a support member (50) of one liner segment (1). This wave crest then extends to the second portion (70) of a support member (50) of adjacent liner segment (1). The trough of the wave is the area of each liner segment (1) between the first portions (60) of the two support members (50).

The inclusion of the front wall (90) and the rear wall (95) provide a strength benefit by reducing the max bending stress on the ends of the liner panel by at least 30% as compared to cantilevered ends without a front wall (90) and the rear wall (95).

Figure 4:
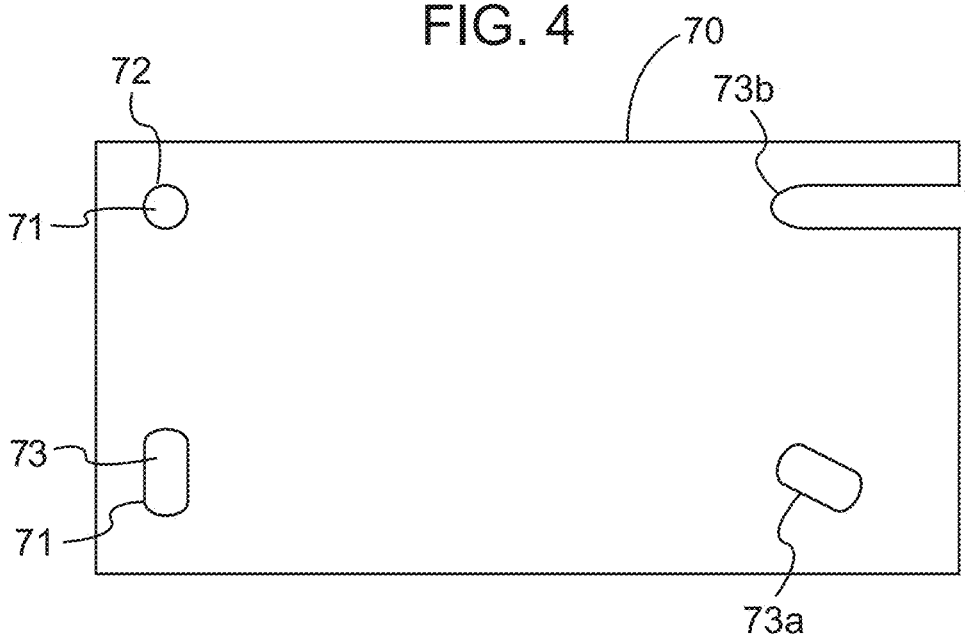
FIG. 4 illustrates a view of the top of the top surface of the second portion a support member various forms of mounting orifices for receiving fasteners.

FIG. 4 shows a top view of the second portion (70) of a support member (50). This view shows various forms of mounting orifices (71). For example, the mounting orifices (71) can be in the form of holes (72) or slots (73) to allow for the passage of fasteners (30). Four different shape options for the mounting orifices (71) are shown, i.e., a hole (72), an oval slot (73), angled oval slot (73*a*), and an open sided slot (73*b*).

The fastener (30) and liner segment (1) may be made from the same materials, for example, both may be made of a superalloy. On the other hand, the fastener (30) and liner segment (1) may be made from different materials, for example, one a superalloy and the other a ceramic matrix composite. Particularly when these parts are made of different materials, relative movement of the parts, e.g., in the engine axial direction or circumferential direction, can occur due to thermal expansion (or contraction) resulting from different coefficients of thermal expansion (CTEs). Similarly, the combustor housing (20) and the liner segment (1) made be made of different materials and relative movement can thus occur between the combustor housing (20) and the liner segment (1) due to different coefficients of thermal expansion. This issue can be addresses by using mounting orifices (71) in the form of slots (73) which can allow for thermal expansion and movement between parts. The slot shape, for example, allows the liner segment (1) to move relative to the fastener (30) and the combustor housing (20). The slots (73) can be arranged at various angles (see, e.g., the angled oval slot (73*a*) of FIG. 4) to optimize the compensation for thermal expansions/contractions between the different parts. Additionally or alternatively, the slots (73*b*) can proceed to the edge of the second portion (70). This arrangement provides for thermal expansions/contractions and can also provide for easier assembly.

Figure 5:
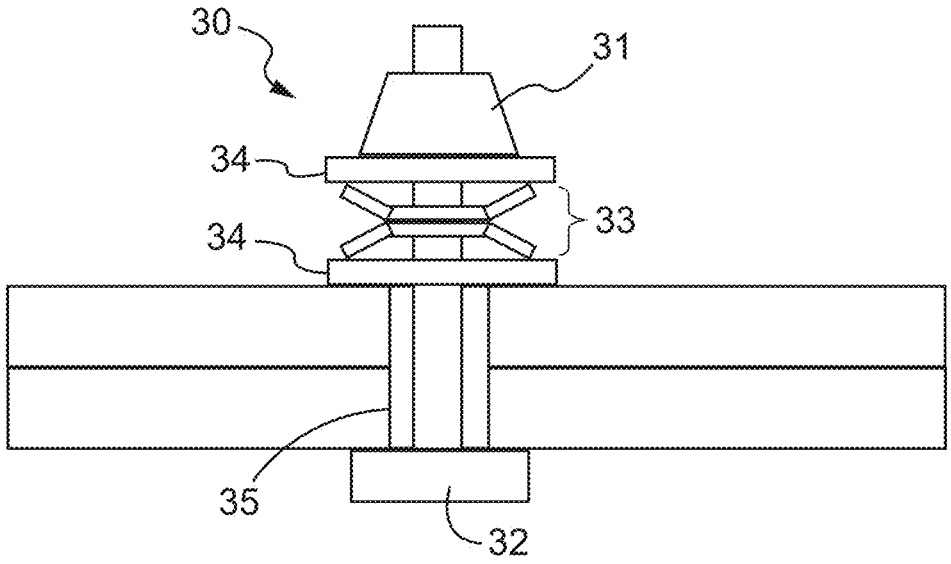
FIG. 5 illustrates a fastener having a washer stack which can be used to attach a liner segment to the combustor housing.

As mentioned above, the fasteners (30) pass through the combustor housing (20) and through the mounting orifices (71) of the second portions (70) of the support members (50). FIG. 5 shows a more detailed structure of an example of a fastener (30) for attaching a liner segment (1) to the combustor housing (20). In this embodiment, the nut (31) and bolt (32) fastener (30) is provided with a Belleville washer stack. The washer stack comprises at least two conical shaped disc springs (33) sandwiched between two flat washers (34). The washer stack is positioned between the nut (14) and the combustor housing (20).

Such a washer stack (33, 34) functions to maintain a clamping load while allowing for radial expansion due to thermal mismatch between, for example, a CMC liner segment and metal components. For example, in the case of expansion of the liner segment (1), the washer stack can compress thereby compensating for the resultant movement and reduce stress imposed by such movement. Alternatively, in the case of contraction of the liner segment (1), the washer stack can exert a force to press the combustor housing (20) and liner segment (1) together and prevent separation. Additionally, the bolt (32) could be subject to expansion and given its length, could expand more than the thinner combustor housing (20). In such a case, the washer stack can exert a force to press the combustor housing (20) and liner segment (1) together and prevent separation. The embodiment of FIG. 5 further shows a bushing (35) surrounding bolt (32) to prevent fastener wear due to sliding in, e.g., slots (73), or relative movement between the bolt (32) and the housing (20).

Other methods are possible for addressing possible movement between components due to differing CTEs. For example, interfaces between a CMC liner segment and metal components can be made thermochemically compatible by the application of suitable coatings. For example, a two-layer coating consisting of a silicon bond coat with a Mullite top coat could be used at the interface between a metal superalloy and CMC components. The CTE of the coating is similar to the CMC substrate but provides a chemical barrier to prevent free silicon in the CMC substrate from reacting with, for example, nickel in the superalloy.

The liner segment embodiment shown in FIGS. 1-3 provides an arrangement that isolates the fasteners (30) from the hot flow path at the inner surface (41). The fasteners (30) are spaced from the inner surface (41) and are separated from hot gases by a physically barrier formed by the liner segment (1). Such an arrangement reduces the possibility of panel burning and stud liberation.

Figure 6A:
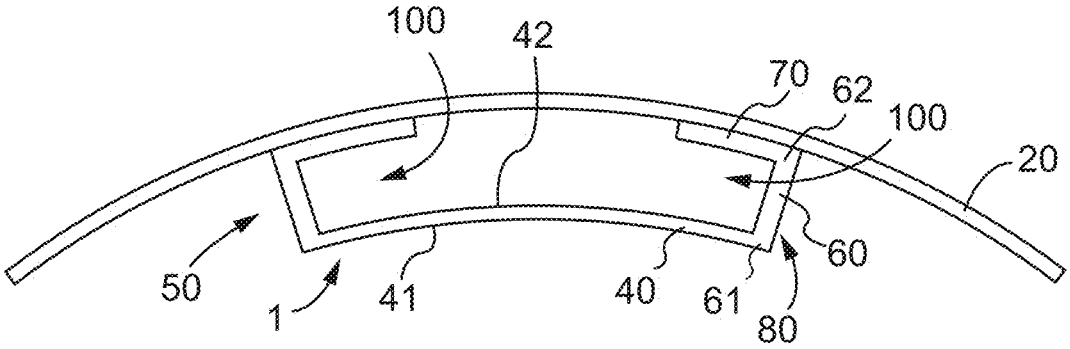
FIGS. 6A, 6B, and 6C illustrate examples of combustor liner segment configurations
Figure 6B:
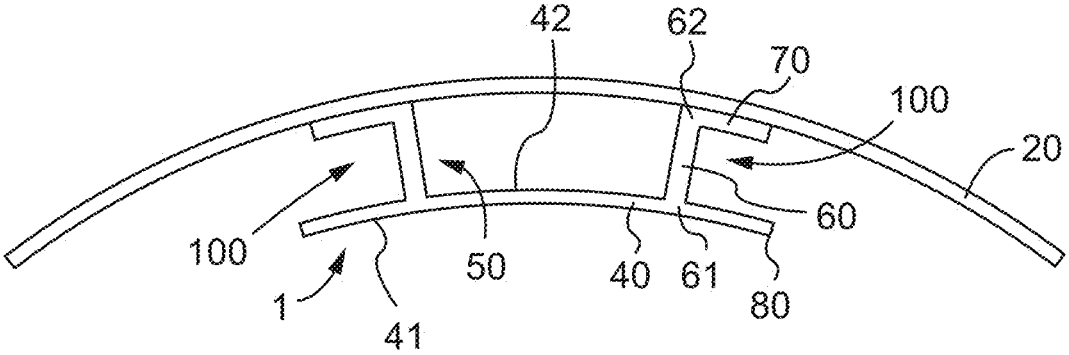
Figure 6C:
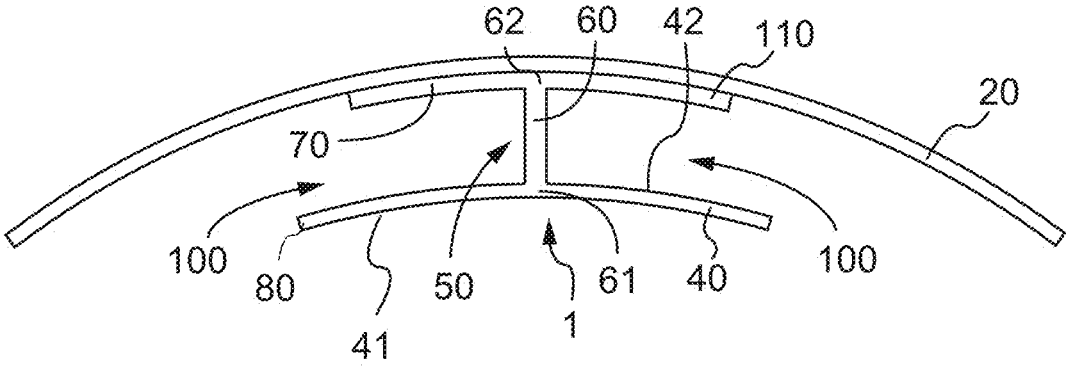

FIGS. 6A, 6B, and 6C shows examples of alternative shapes for the liner segments (1) which also provide an arrangement that isolate the fasteners (30) from the hot flow path at the inner surface (41). In particular, these liner segment alternative embodiments involve different support member (50) configurations. In these configurations, the first portions (60) of the support members (50) are perpendicular to the base (40), rather than angled as shown in FIGS. 1-3.

In FIG. 6A, the liner segment (1) has two support members (50). Each of the two support members (50) has a first portion (60) which comprises a first end (61) and a second end (62). The first end (61) is connected to one of the side edges (80) of the base (40), and the first portion (60) extends perpendicular to the outer surface (42). The second portion (70) extends laterally from the second end (62) of the first portion (60) in a direction toward a center region of the outer surface (42) and is spaced from the outer surface (42). Such a configuration forms a C shape.

In this embodiment, the first portion (60) and second portion (70) of each support member (50), together with the base (40), the front wall (90) and rear wall (95), partially enclose a space (100) which can house the fasteners and protect them from the hot flow path of the combustor. When the combustor liner segment (1) is attached to combustor housing (20), the fasteners extend through mounting orifices in the second portion (70) of each support member (50) and into the respective partially enclosed space (100). Additionally, when the combustor liner segment (1) is attached to combustor housing (20), the two respective partially enclosed spaces form parts of a larger enclosure. The combustor housing (20) also forms part of this larger enclosure by bridging the gap between the second portion (70) of one support member (50) of liner segment (1) and the second portion (70) of the other support member (50) of the same liner segment (1). The fasteners (30) are positioned within this larger enclosure and are shielded from the flow of hot gases through the combustor.

In FIG. 6B, the liner segment (1) has two support members (50). Each of the two support members (50) has a first portion (60) which comprises a first end (61) and a second end (62). Each of the first ends (61) is connected to the base (40) at a position spaced from one of the side edges (80), and the first portion (60) extends perpendicular to the outer surface (42). The second portion (70) extends laterally from the second end (62) of the first portion (60) in a direction toward the side edge (80) and is spaced from the outer surface (42). Such a configuration can be formed from CMC material using a PI weave.

In this embodiment, the first portion (60) and second portion (70) of each support member (50), together with the base (40), the front wall (90) and rear wall (95), partially enclose a space (100) which can house the fasteners and protect them from the hot flow path of the combustor. When the combustor liner segment (1) is attached to combustor housing (20), the fasteners extend through mounting orifices in the second portion (70) of each support member (50) and into the respective partially enclosed space (100). When two combustor liner segments are positioned next to each other (see, e.g., FIG. 1), and attached to the combustor housing (20), a partially enclosed space formed by one liner segment and a partially enclosed space formed by the adjacent liner segment together form parts of a larger enclosure. The combustor housing (20) forms part of this larger enclosure by bridging the gap between the second portion (70) of a support member (50) of one liner segment and the second portion (70) of the support member (50) of an adjacent liner segment. The fasteners (30) are positioned within this larger enclosure and are shielded from the flow of hot gases through the combustor.

In FIG. 6C, the liner segment (1) has only a single support member (50). The first end (61) of the first portion (60) is connected to the base (40) at a central region of outer surface (42), and the first portion (60) extends perpendicular to the outer surface (42). The second portion (70) extends laterally from the second end (62) of the first portion (60) in a direction toward one of the side edges (80) of the base (40) and is spaced from the outer surface (42).

The support member (50) further includes a third portion (110). The third portion (110) extends laterally from the second end (62) of the first portion (60) in a direction toward the other side edge (80) of the base (40) and is spaced from the outer surface (42). Like the second portion (70), the third portion (110) is provided with one or more mounting orifices for receiving fasteners. In this configuration, the base (40) and the support member (50) form an I shape.

In embodiment of FIG. 6C, the first portion (60) and second portion (70) of the single support member (50), together with the base (40), the front wall (90) and rear wall (95), partially enclose a space (100) which can house the fasteners and protect them from the hot flow path of the combustor. Similarly, the first portion (60) and third portion (110) of the single support member (50), together with the base (40), the front wall (90) and rear wall (95), partially enclose another space (100) which can house the fasteners and protect them from the hot flow path of the combustor.

When the combustor liner segment (1) is attached to combustor housing (20), the fasteners extend through mounting orifices in the second portion (70) of the single support member (50) and into the respective partially enclosed space (100). Additionally, fasteners extend through mounting orifices in the third portion (110) of the single support member (50) and into the respective partially enclosed space (100). When two combustor liner segments are positioned next to each other (see, e.g., FIG. 1), and attached to the combustor housing (20), a partially enclosed space formed by one liner segment and a partially enclosed space formed by the adjacent liner segment together form parts of a larger enclosure. The combustor housing (20) forms part of this larger enclosure by bridging the gap between the second portion (70) of a support member (50) of one liner segment and the third portion (110) of a support member (50) of an adjacent liner segment. The fasteners (30) are positioned within this larger enclosure and are shielded from the flow of hot gases through the combustor.

Figure 7:
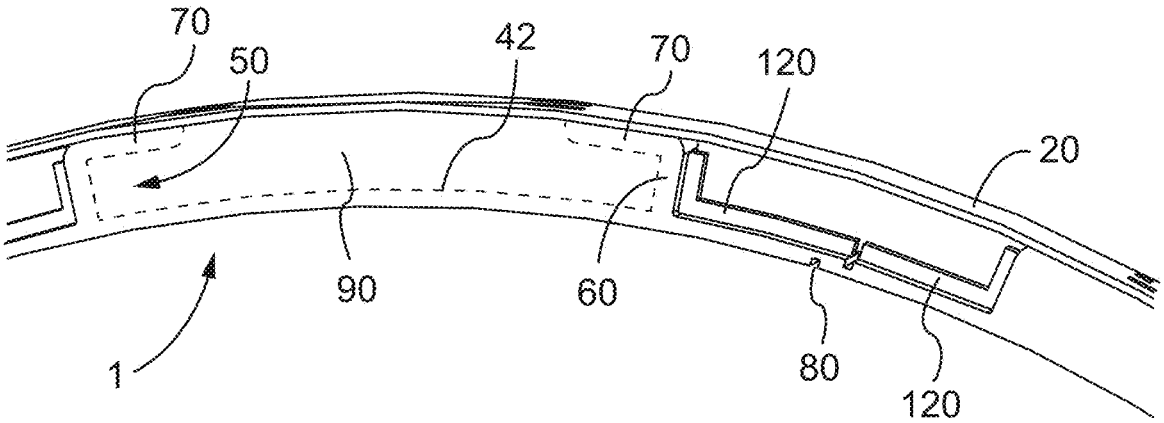
FIG. 7 illustrates a view of a front view of combustor liner panel with and reinforcement members in contact with first portions of support members.

FIG. 7 shows an embodiment which includes reinforcement members. In FIG. 7 the front wall (90) of the liner segment (1) is visible. In this embodiment, two support members (50) are oriented such that their second portions (70) extend in a direction away from each of the side edges (80) of the liner segments (1), i.e., toward the center region of the outer surface (42), as in the embodiment of FIG. 6A. However, in the embodiment of FIG. 7, the base (40) extends past the point of attachment of the first portion (60) of each support member (50), like the base (40) shown in FIG. 6B, defining two side regions of the outer surface (42).

As shown in FIG. 7, L-shaped reinforcing members (120) are provided for each support member (50). The reinforcing members (120) serve to reinforce the strength and rigidity of the structure around the area where adjacent liner segments (1) are joined together.

Each reinforcing member (120) is attached to an outer surface of the first portion (60) of a support member (50) and also is attached to one of the side regions of the outer surface (42) of the base (40). The portion of the reinforcement member (120) attached to the side region of the outer surface (42), i.e., the base of the L shape, extends from the outer surface of the first portion (60) in a direction toward a side edge (80) of the base (40). This portion may, optionally, extend beyond the side edge (80) of the liner segments (1) and form a shiplap joint with the reinforcement member (120) of an adjacent liner segment (1). In such an arrangement, the reinforcement member (120) can substitute for, or supplement, a joint member (85) used to join adjacent liner segments (1).

Figure 8:
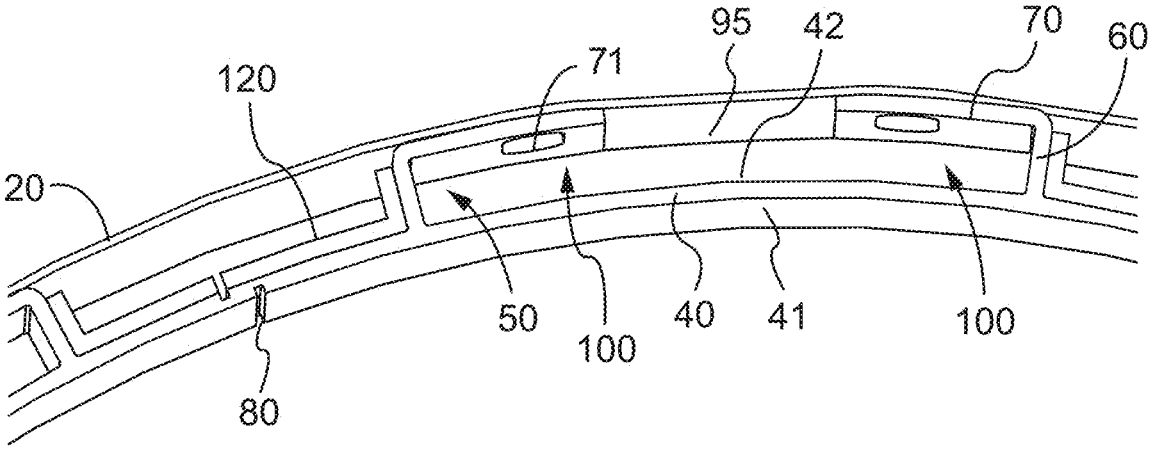
FIG. 8 illustrates a cross sectional view of the liner segment of FIG. 7 that is slightly tilled to show the underside of second potions of the support members.

FIG. 8 shows a cross sectional view of the liner segment of FIG. 7 that is slightly tilted to show the underside of second potions (70) of support members (50). In FIG. 8 the rear wall (95) of the liner segment (1) is visible. Mounting orifices (11) are provided in each of the second portions (70). The second portion (70) of each of the two support members (50) extends in a direction away from each of the side edges (80) of the liner segments (1), i.e., toward the center region of the outer surface (42). The first portion of each support member (50) extends perpendicularly from the outer surface (42).

In this embodiment, the first portion (60) and second portion (70) of each support member (50), together with the base (40), the front wall (90) and rear wall (95), partially enclose a space (100) which can house the fasteners and protect them from the hot flow path of the combustor. When the combustor liner segment (1) is attached to combustor housing (20), the fasteners extend through mounting orifices in the second portion (70) of each support member (50) and into the respective partially enclosed space (100). Additionally, when the combustor liner segment (1) is attached to combustor housing (20), the two respective partially enclosed spaces form parts of a larger enclosure. The combustor housing (20) also forms part of this larger enclosure by bridging the gap between the second portion (70) of one support member (50) of liner segment (1) and the second portion (70) of the other support member (50) of the same liner segment (1). The fasteners (30) are positioned within this larger enclosure and shielded from the flow of hot gases through the combustor.

Figure 9:
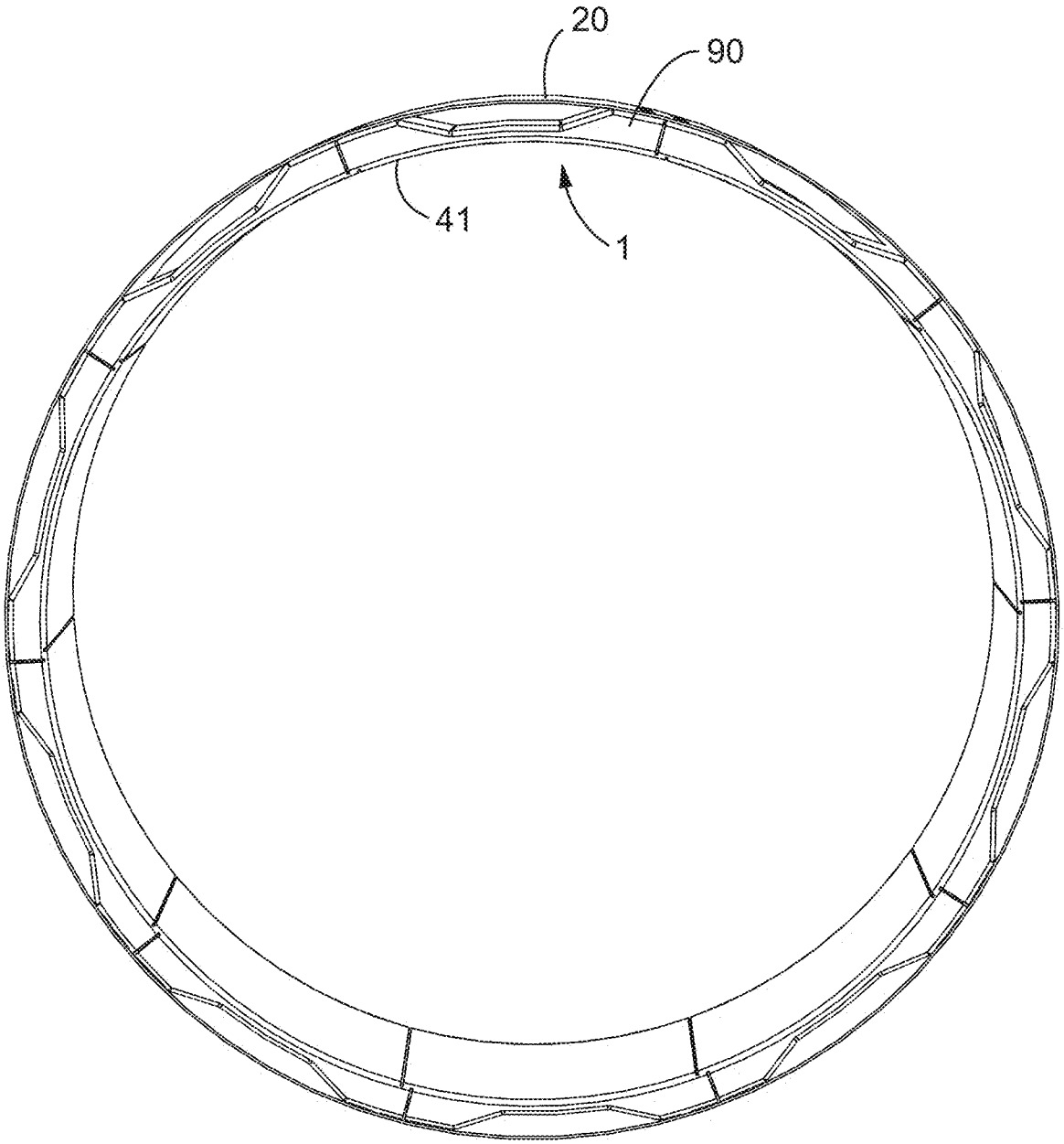
FIG. 9 shows a combustor housing and a number of liner segments joined together to form a combustor liner panel.

FIG. 9 shows a completed combustor liner panel. The panel is formed from a plurality of liner segments (1) joined together and attached to the inner surface of combustor housing (20). In the embodiment FIG. 9, the front walls 90 of the liner segments are visible. The liner segments in FIG. 9 have the configuration of the liner segment shown in FIGS. 1-3. As described with respect to FIG. 3, the panel shows a repeating wavelike pattern where the wave peaks are in the area where adjacent liner segments (1) join together and the wave troughs are in the central area of each liner segments (1).

In general, embodiments of concepts disclosed herein are directed to prevention of exposure of the fasteners, used in joining combustor liner segments to the combustor housing, to the hot flow path of a combustor. The liner segments include support members which allow for the attachment of the liner segments to the combustor housing via the fasteners in a manner which form partially enclosed space(s) to protect the fasteners from the flow path of hot gases.

As will be appreciated by one skilled in the art, the embodiments described herein may be embodied as a method, product, or part for use in, for example, a gas turbine engine assembly. Accordingly, embodiments described herein may take the form of a portion of a gas turbine engine assembly.

The corresponding structures, material, acts, and equivalents of all means or steps plus function elements in the claims below are intended to include any structure, material, or act for performing the function in combination with other claimed elements are specifically claimed. The description of the embodiments described herein has been presented for purposes of illustration and description, but is not intended to be exhaustive or limited to the invention in the form disclosed. Many modifications and variations will be apparent to those of ordinary skill without departing from the scope and spirit of the invention. The embodiments were chosen and described in order to best explain the principles of the invention and the practical application, and to enable others of ordinary skill in the art to understand the invention for embodiments with various modifications as are suited to the particular use contemplated.

Modifications and equivalents may be made to the features of the claims without departing from the spirit or scope of the invention. Thus, it is intended that the embodiments described herein covers the modifications and variations disclosed above provided that these changes come within the scope of the claims and their equivalents.

The invention claimed is:

1. A combustor liner segment comprising:

a base comprising an inner surface, an outer surface, a front edge, a rear edge, and two side edges, a front wall arranged perpendicular to said base and extending from said front edge, and a rear wall arranged perpendicular to said base and extending from said rear edge, and at least one support member wherein each support member comprises a first portion and a second portion, wherein the first portion has a first end and a second end and the first end is connected to the outer surface of said base, wherein the second portion extends laterally from the second end of the first portion and is spaced from the outer surface of said base, wherein the second portion comprises at least one mounting orifice, wherein the first portion, the second portion, the outer surface, the front wall, and the rear wall form a not fully enclosed space, and wherein the at least one support member of said combustor liner segment has only one support member and the first portion of said support member is perpendicular to the outer surface of said base, and extends from a central region of the outer surface.

2. The combustor liner segment of claim 1, wherein the combustor liner segment has at least two of said support members.

3. The combustor liner segment of claim 2, wherein the first portion of each support member is angled with respect to the outer surface of said base, and extends from a central region of the outer surface.

4. The combustor liner segment of claim 2, wherein the first portion of each support member is perpendicular to the outer surface of said base.

5. The combustor liner segment of claim 4, wherein the first portion of each support member extends from a central region of the outer surface.

6. The combustor liner segment of claim 1, wherein the at least one support member of said support member further comprises a third portion which is spaced from the outer surface of said base and which extends laterally from the second end of the first portion in a direction opposite to that of the second portion, wherein the third portion comprises the at least one mounting orifice.

7. The combustor liner segment of claim 1, wherein the combustor liner segment is comprised of a ceramic matrix composite.

8. The combustor liner segment of claim 1, wherein the combustor liner segment additionally comprises a joint member attached to the outer surface of at least one of said two side edges wherein said joint member extends beyond the at least one of said two side edges.

9. The combustor liner segment of claim 1, wherein said at least one mounting orifice is a hole or a slot.

10. The combustor liner segment of claim 1, wherein said at least one mounting orifice is a slot having an oval shape.

11. The combustor liner segment of claim 1, further comprising at least one reinforcement member.

12. The combustor liner segment of claim 11, wherein at least one of the at least one reinforcement member has a first portion which is attached to an outer surface of the first portion of a support member, and the reinforcement member has a second portion which is attached to the outer surface of the base and extends from the outer surface of the first portion toward a side edge of the base.

13. A combustor comprising:

a combustor housing having an inner radial surface and an outer radial surface; and at least three combustor liner segments, wherein each of said at least three combustor liner segments comprise:

a base comprising an inner surface, an outer surface, a front edge, a rear edge, and two side edges, a front wall arranged perpendicular to said base and extending from said front edge, and a rear wall arranged perpendicular to said base and extending from said rear edge, and at least one support member wherein each support member comprises a first portion and a second portion, wherein the first portion has a first end and a second end and the first end is connected to the outer surface of said base, wherein the second portion extends laterally from the second end of the first portion and is spaced from the outer surface of said base, wherein the second portion comprises at least one mounting orifice, and wherein the first portion, the second portion, the outer surface, the front wall, and the rear wall form a not fully enclosed space; and wherein the second portion of each support member of each of said at least three combustor liner segments is attached to the combustor housing via a fastener passing through mounting orifices and extending into the not fully enclosed space.

14. The combustor according to claim 13, wherein each of said at least three combustor liner segments have at least two of said support members and the first portion of each support member is angled with respect to the outer surface of said base, and extends vertically from a central region of the outer surface of said base.

15. The combustor according to claim 13, wherein each of said at least three combustor liner segments have at least two of said support members and the first portion of each support member is perpendicular to the outer surface of said base.

16. The combustor according to claim 15, wherein the first portion of each support member extends from one of the side edges of said base, or the first portion of each support member extends from a central region of the outer surface.

17. The combustor according to claim 13, wherein each of said at least three combustor liner segments have only one support member and the first portion of said support member is perpendicular to the outer surface of said base, and extends from a central region of the outer surface.

18. A method of assembling a combustor comprising:

providing a combustor housing having an inner surface and an outer surface; and attaching the outer surface of the combustor housing to at least three liner segments by fasteners that pass through at least one mounting orifice of the at least three liner segments, wherein each of said at least three liner segments comprise:

a base comprising an inner surface, an outer surface, a front edge, a rear edge, and two side edges, a front wall arranged perpendicular to said base and extending from said front edge, and a rear wall arranged perpendicular to said base and extending from said rear edge, and at least one support member wherein each of said at least one support members comprise a first portion and a second portion, wherein the first portion has a first end and a second end and the first end is connected to the outer surface of said base, wherein the second portion extends laterally from the second end of the first portion and is spaced from the outer surface of said base, wherein the second portion comprises the at least one mounting orifice, and wherein the first portion, the second portion, the outer surface, the front wall, and the rear wall form a not fully enclosed space, and wherein the at least one support member of said combustor liner segment has only one support member and the first portion of said support member is perpendicular to the outer surface of said base, and extends from a central region of the outer surface.

* * * * *